US006599074B2

(12) United States Patent
Parker

(10) Patent No.: US 6,599,074 B2
(45) Date of Patent: Jul. 29, 2003

(54) BINDER STRIP HAVING ENCODED SURFACE AND METHOD

(75) Inventor: Kevin P. Parker, Berkeley, CA (US)

(73) Assignee: Powis Parker Inc., Berkeley, CA (US)

( * ) Notice: Subject to any disclaimer, the term of this patent is extended or adjusted under 35 U.S.C. 154(b) by 0 days.

(21) Appl. No.: 09/812,356

(22) Filed: Mar. 19, 2001

(65) Prior Publication Data

US 2002/0131847 A1 Sep. 19, 2002

(51) Int. Cl.[7] ..... B42B 5/00

(52) U.S. Cl. ..... 412/33; 412/28; 412/36; 281/5; 281/9; 281/21.1; 281/28; 156/908; 428/913; 235/462.01; 235/462.02; 235/462.03; 235/462.04; 235/462.05; 235/462.06; 235/462.07; 235/462.08; 235/462.1; 235/454; 235/494

(58) Field of Search ..... 281/5, 9, 21.1, 281/28; 412/28, 33, 36; 156/908; 428/913; 235/462.01, 462.02, 462.03, 462.04, 462.05, 462.06, 462.07, 462.08, 462.09, 462.1, 494, 454

(56) References Cited

U.S. PATENT DOCUMENTS

| | | | | | |
|---|---|---|---|---|---|
| 4,496,617 | A | * | 1/1985 | Parker | 281/21 |
| 5,052,873 | A | * | 10/1991 | Parker et al. | 412/13 |
| 5,066,183 | A | | 11/1991 | Tholerus | 412/4 |
| 5,193,962 | A | * | 3/1993 | Parker et al. | 412/8 |
| 5,452,920 | A | * | 9/1995 | Parker | 281/21.1 |
| 5,601,915 | A | * | 2/1997 | Ochi et al. | 428/323 |
| 5,613,711 | A | * | 3/1997 | Parker | 281/21.1 |
| 5,833,423 | A | * | 11/1998 | Yamaguchi et al. | 412/8 |
| 5,997,964 | A | * | 12/1999 | Klima, Jr. | 428/1 |
| 6,065,884 | A | * | 5/2000 | Parker et al. | 400/611 |
| 6,155,763 | A | * | 12/2000 | Parker et al. | 412/6 |
| 2002/0064437 | A1 | * | 5/2002 | Kuramoto et al. | 412/37 |

* cited by examiner

*Primary Examiner*—A. L. Wellington
*Assistant Examiner*—Mark T. Henderson
(74) *Attorney, Agent, or Firm*—Girard & Equitz LLP

(57) ABSTRACT

An encoded binder strip having an adhesive matrix and an encoded pattern formed on a surface of the matrix to identify the type of binder strip. The encoded pattern includes relatively high reflectivity regions and relatively low reflectivity regions. Preferably, the encoded pattern is read as the binder strip is fed into a binding machine, with the encoded pattern controlling operation of the machine.

33 Claims, 5 Drawing Sheets

BINDER STRIP HAVING ENCODED SURFACE AND METHOD

BACKGROUND OF THE INVENTION

1. Field of the Invention

The present invention relates generally to binder strips used to bind a stack of sheets to form a book and, in particular, a binder strip used in a binding machine having an encoded surface which can be read by the binding machine.

2. Description of Related Art

Binder strips utilizing heat activated adhesives are commonly used to bind a stack of sheets using a desk top binding machine. A typical binder strip is disclosed in detail in U.S. Pat. No. 4,496,617, the contents of which are fully incorporated herein by reference. Referring to the drawings, FIG. 1 shows an exemplary binder strip 10, with the adhesive side exposed. The strip includes an elongated substrate (not designated), typically made of paper. A central band 14 of heat activated adhesive is disposed along the length of the substrate. When activated by heat, band 14 becomes molten and has a low viscosity so as to wet the edges of the pages to be bound. A pair of outer adhesive bands 12A and 12B are provided which are made of a heat activated adhesive which is high tack and high viscosity. The outer bands function to secure the strip to the front and back cover sheets of the bound stack.

The actual binding of a stack is usually carried out by a desk top binding machine such as described in U.S. Pat. No. 5,052,873, the contents of which are fully incorporated herein by reference. FIG. 2 is a simplified diagram of an exemplary binding machine 18. The binding machine supports the stack 20 of sheets to be bound. An operator inserts a single strip 10 into an opening 21 located in the side of the machine. A sensor detects the presence of the strip 10, causing a drive motor to be activated, which causes the strip to be drawn into the machine by of a pair of pinch rollers. Once the strip is loaded into the machine, the strip is applied to the stack 20 using both pressure and heat so as to bind the stack.

Originally, the typical binding machine 18 operated with basically one type of elongated binder strip 10, with there being narrow, medium and wide strips to accommodate thin, medium and thick stacks of sheets, respectively, to be bound. A typical binding machine includes apparatus for automatically measuring the stack 20 of sheets to be bound and then indicating to an operator, by way of a display 24, the width of binder strip to be inserted into the machine. The machine is provided with various apparatus for either preventing an operator from inserting a binder strip of incorrect width into the machine or for detecting the width of the strip and then ejecting a strip if the width is incorrect.

More recently, various new types of binder strips have been developed, or are in the process of being developed, which incorporate different binding techniques. The binding machines are ideally configurable to operate differently depending upon the type of strip being used. By way of example, some strips inherently require less time to heat the heat activated adhesive than other strip types. In those cases where less time is required, the machine could complete a binding sequence more quickly as compared to other strip types. The machine must have the information as to the type of strip being used so that the binding sequence can be appropriately modified. For other types of strips, the end of the strip first inserted into the machine is critical. If the wrong end is inserted first, a proper bind cannot be carried out.

One approach would be for the operator to communicate this information to the machine by some form of manual data entry such as a keyboard 22 (FIG. 2) or the like. However, one very important objective of most desktop binding systems is to permit anyone having a minimal amount of training to operate the binding machine. If an operator is required inspect a binder strip and to then manually input the necessary information into the machine, the operator must be well trained. In any event, it is preferable to minimize the need for such manual input since even a trained operator can make an error that may result in damaging the stack of sheets to be bound. This problem will become more acute when numerous new types of strips are developed.

In addition, binder strips sometimes include gaps in the adhesive near both ends of the strip. As shown in FIG. 1, the outer adhesive bands 12A and 12B extend to both ends of the strip, but the central adhesive band 14 does not. Thus, gaps 16A and 16B are formed in the adhesive. These gaps function to receive excess molten adhesive 14 during the binding sequence. If the gap at the distal end of the strip, the end first inserted into the machine, is not present, the excess adhesive 14 at that end will have a tendency to flow away from the strip and on to components of the binding machine.

Since both ends of the strip 10 are provided with such gaps, the operator normally need not be concerned as to which end is first inserted into the machine. However, in some instances, an operator will cut a strip to accommodate a stack having a non-standard length. By way of example, a strip that is 11 inches long could be cut to 8½ inches so that the top edge of an 8½ by 11 inch stack can be bound rather than the normal 11 inch edge. In that event, the cut edge of the strip will not have a gap. This is not a problem if an operator knows or remembers to insert the cut strip with the end having a gap into the machine first. However, if the operator inserts the cut end first, the machine could be contaminated with adhesive.

The present invention overcomes the above-noted shortcoming of prior art strips by providing an efficient manner of encoding strips with information, typically relating to the strip type and strip direction of travel during insertion, which can be sensed by the binding machine without intervention by the operator. The binding sequence can then be automatically optimized for the strip type. The encoding also preferably indicates which strip end was inserted first so, if incorrect, the machine can sense the error, eject the strip and display an error message instructing the operator to properly reinsert the strip. These and other advantages of the present invention will become apparent to those skilled in the art upon a reading of the following Detailed Description of the Invention together with the drawings.

SUMMARY OF THE INVENTION

An encoded binder strip which controls operation of a binding machine. The binder strip includes an elongated substrate and an adhesive matrix disposed on a surface of the substrate. A predetermined encoded pattern is formed on the surface of the matrix, with the pattern including relatively low and relatively high reflectivity regions. The encoded pattern can be sensed when the machine is loaded into the binding machine so that the machine operation is optimized for the particluar type of binder strip.

DETAILED DESCRIPTION OF THE INVENTION

Figure 3:
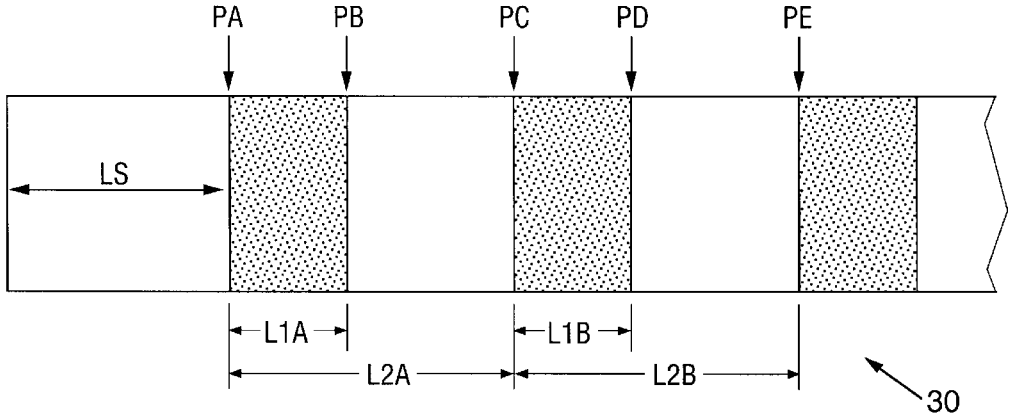
FIG. 3 shows a portion of a binder strip in accordance with the present invention having an encoded surface.

Referring again to the drawings, FIG. 3 depicts part of the adhesive surface of an encoded binder strip 30 in accordance with the present invention. The encoding is preferably accomplished by varying the reflective characteristics of the adhesive surface of the binder strips. The light and dark bands on the adhesive strip of FIG. 3 represent high and low reflectivity areas, respectively. The normal surface of the adhesive has a fairly high reflectivity. It has been found that selectively abrading the surface of the adhesive is one technique for reducing the reflectivity. Another technique is to pass the adhesive over a rough surface soon after the molten adhesive has been applied to the substrate during the manufacture of the binder strip, as will be explained in greater detail. In both cases, the adhesive surface is textured to reduce the reflectivity.

Figure 5:
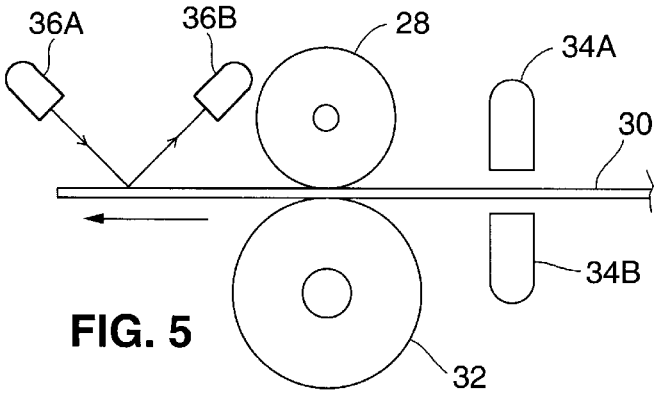
FIG. 5 is a simplified diagram of a sensor arrangement installed in a binding machine for reading an encoded binder strip.

FIG. 5 is a simplified schematic diagram of a portion of a modified strip loading mechanism of a binding machine. As previously noted in connection with FIG. 2, an operator inserts one end of a binder strip into the machine. An outer optical sensor, which includes a light source 34A such as a LED and a light detector 34B such as a photodiode, senses that a strip has been inserted into the machine. A drive motor (not depicted) is then automatically activated which drives a drive roller 32. The strip 30 is drawn into the machine between the drive roller 32 and a pinch roller 28. A reflectivity sensor including a transmitter section 36A and receiver section 36B is disposed above the strip feed path so that the encoding on the strip can be read as the strip is loaded into the machine. The drive motor is a stepper motor so that the number of steps that the motor is driven corresponds to a given location on the strip. The number of steps can be stored in a memory for later reference.

Figure 6:
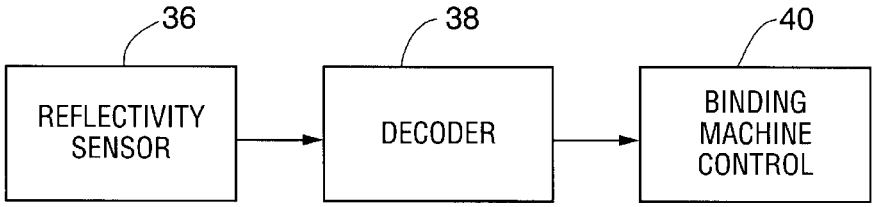
FIG. 6 is a block diagram of the binding machine apparatus for sensing the encoded strip, decoding the information and for controlling the action of the binding machine in response to decoded information.

As can be seen in FIG. 6, the output of the reflectivity sensor is forwarded to a decoder 38. The decoded information typically relates to that type of binder strip that was just loaded into the machine. That information is sent to the binding machine control circuitry as represented by block 40. This information may, for example, modify the amount of time that an adhesive is heated or may simply cause the machine to eject the loaded tape and to display an error message such as "Strip Inserted Incorrectly—Reverse Strip and Reinsert".

In one embodiment, the strip type is determined by comparing that portion of the strip that has a relatively high reflectivity to that portion that has a relatively low reflectivity. A unique pattern is formed on the strip and is repeated several times to reduce the likelihood of errors. By way of example, FIG. 3 shows an encoded surface of a portion of a binder strip 30, with dimension L2A, L2B, etc representing the common length of the repeating pattern. Thus, the region between points PA and PC encompasses one complete cycle of the pattern, with the region between points PC and PE encompass a second complete cycle of the same pattern. This common cycle length may be, for example, one inch for all strip types and includes a relatively low reflectivity portion represented by the dark sections of the drawing (the region between points PA and PB, for example) and a relatively high reflectivity portion represented by the light sections of the drawing (the region between points PB and PC, for example). The length L1A, L1B, etc. of the low reflectivity portion, corresponds to the binder strip type. To reduce error, the ratio of L1 to L2 is actually used to identify the strip type. Thus, for example, ratios of 1/8, 2/8, 3/8, 4/8, 5/8, 6/8 and 7/8 may represent seven different strip types.

Figure 2:
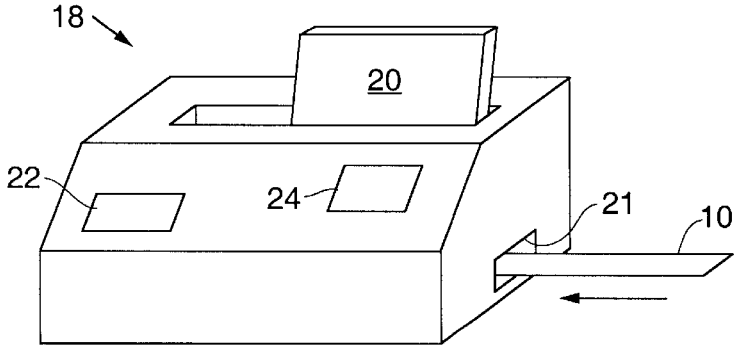
FIG. 2 PRIOR ART
FIG. 2 is a simplified elevational view of a conventional desk top binding machine.
Figure 4A:
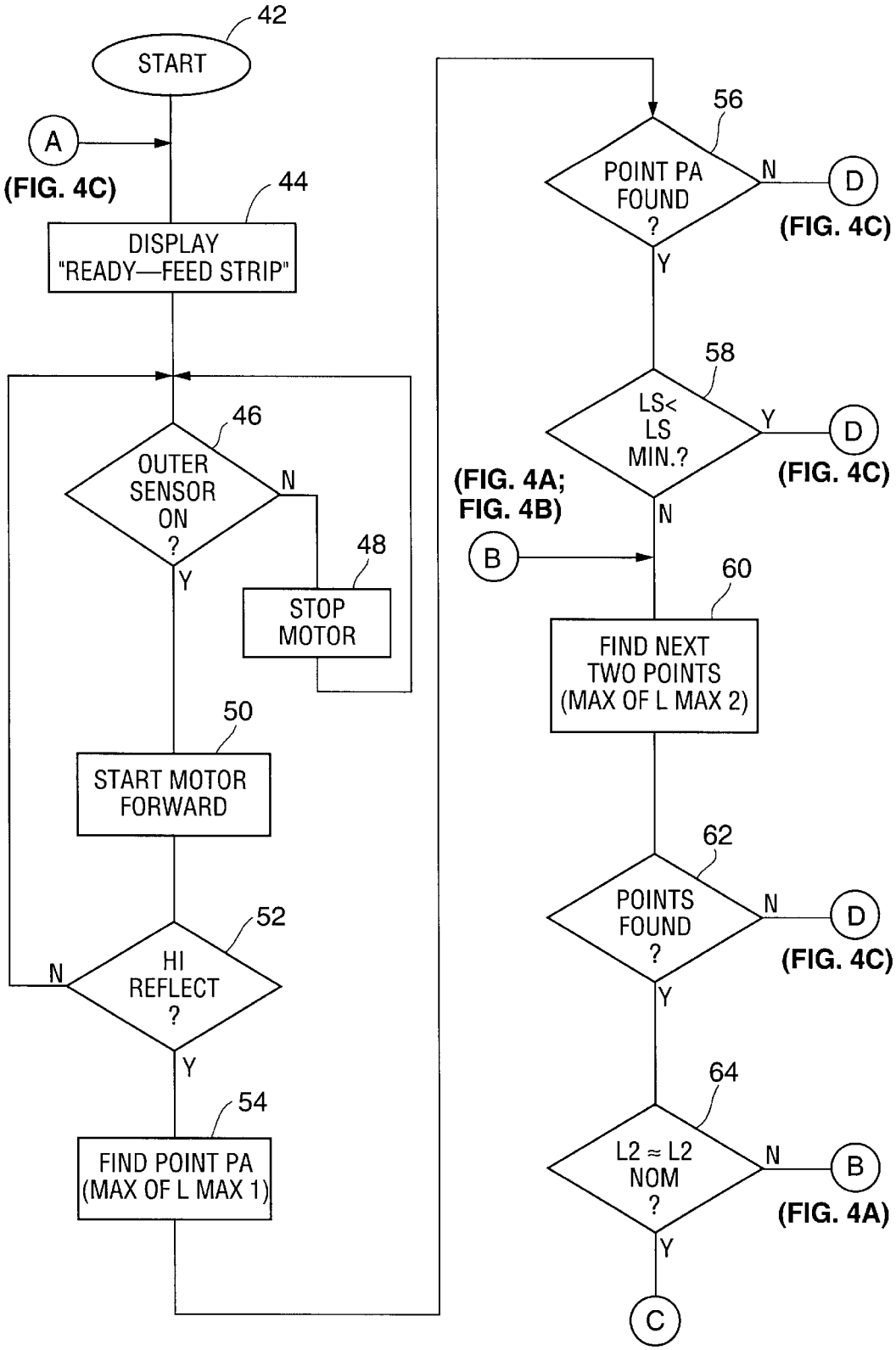
FIGS. 4A, 4B and 4C are flow charts, illustrating the operation of a binding machine configured to read an encoded binder strip in accordance with the present invention.
Figure 4B:
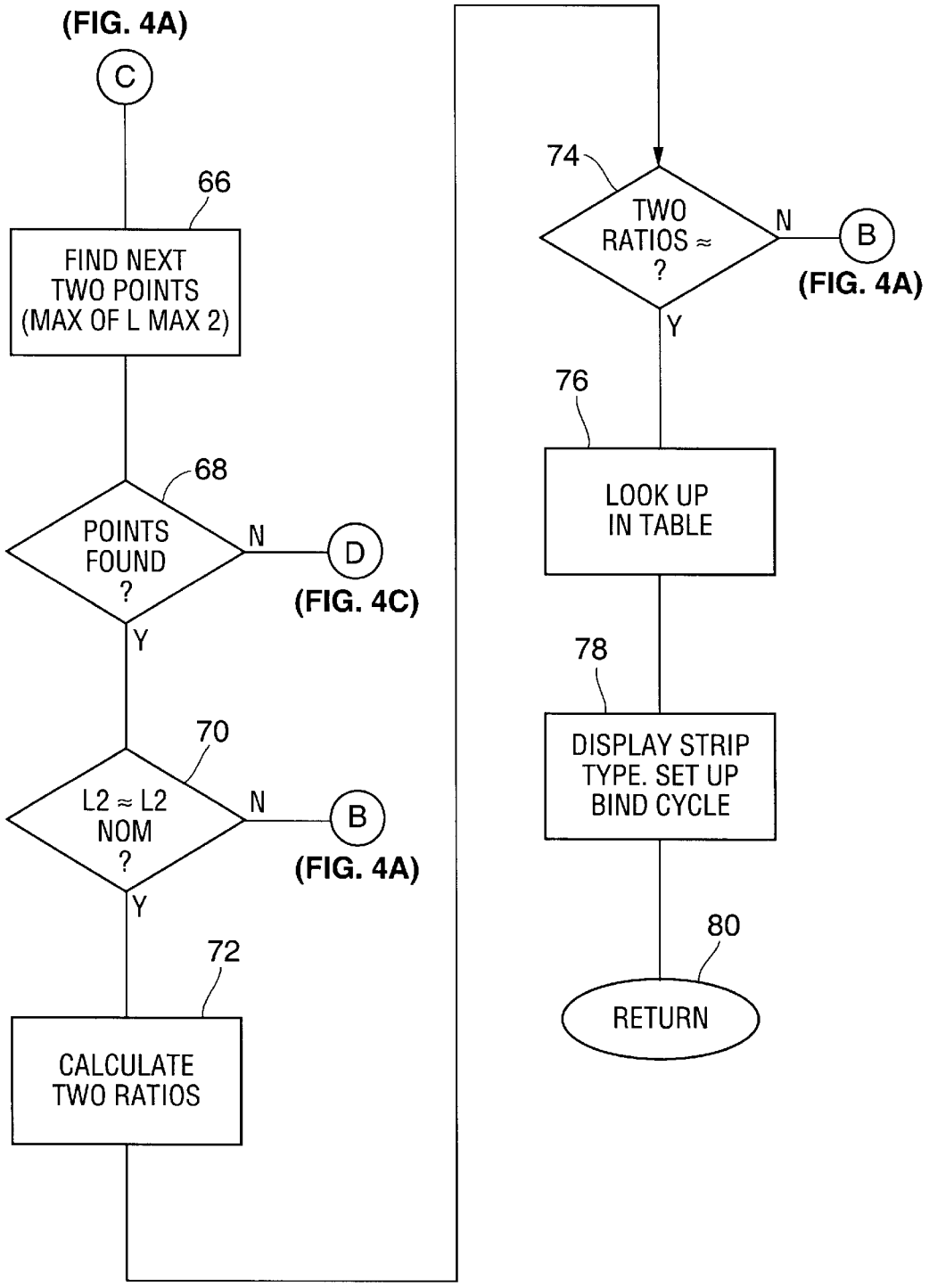
Figure 4C:
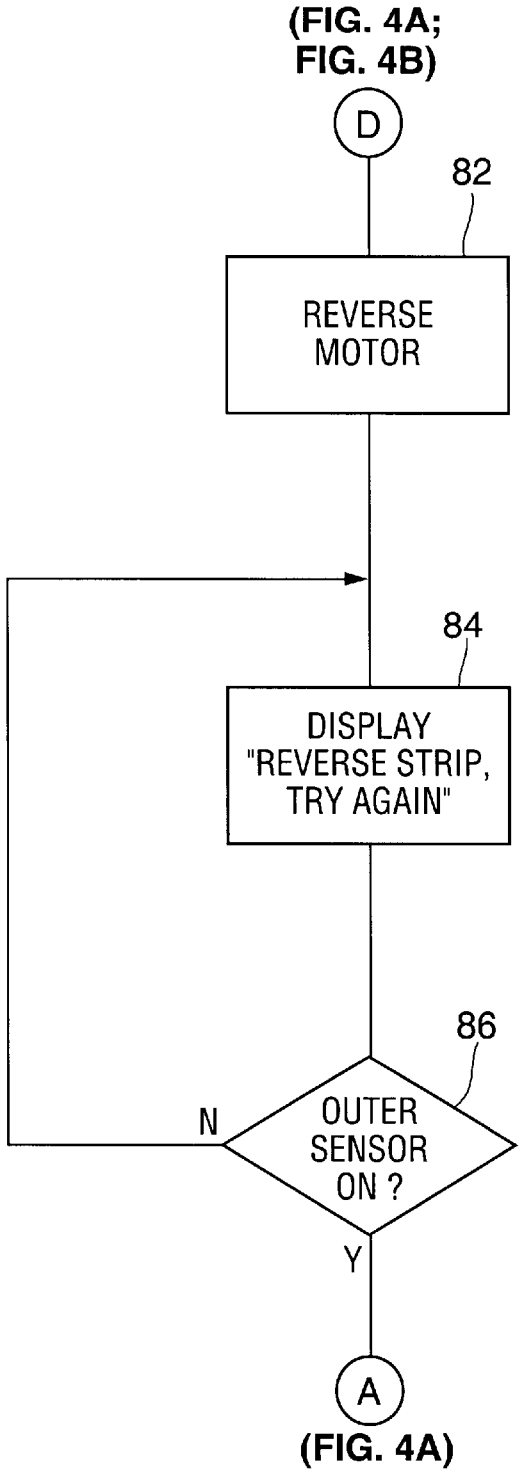

FIGS. 4A, 4B and 4C represent an exemplary decoding sequence used to read an encoded strip. One goal of the decoding sequence is to eliminate potential errors due to damaged or otherwise defective encoding on a binder strip. Thus, a substantial amount of redundancy is employed in the encoded strip itself and in the decoding sequence. Referring to FIG. 4A, the sequence begins as indicated by element 42. At this point, an operator has placed a stack 20 of sheets in binding machine 18 as shown in FIG. 2. In most cases, the binding machine will then sense the thickness of the stack 20 and will indicate by way of display 24 the width of binder strip to be inserted into the machine (wide, medium or narrow). As indicated by block 44, the display will then instruct the operator to insert a strip 10 of appropriate width into opening 21 of the binding machine. The drive motor (not shown) will then be turned on and will proceed to cause the strip to be drawn into the machine. As indicated by element 46, the outer optical sensor (transmitter 34A and receiver 34B of FIG. 5) determines whether a strip 10 is disposed within the sensor. At this point, if a strip is not sensed, it usually means the operator has, for some reason, withdrawn the strip from the machine. This will cause the drive motor to stop, as represented by block 48. If a strip 10 is sensed, the strip is driven into the machine, with the strip passing under the reflectivity sensor 36A/36B. The location of the strip with respect to sensor 36A/36B is always known since the number of step motor steps is counted and recorded.

Figure 1:
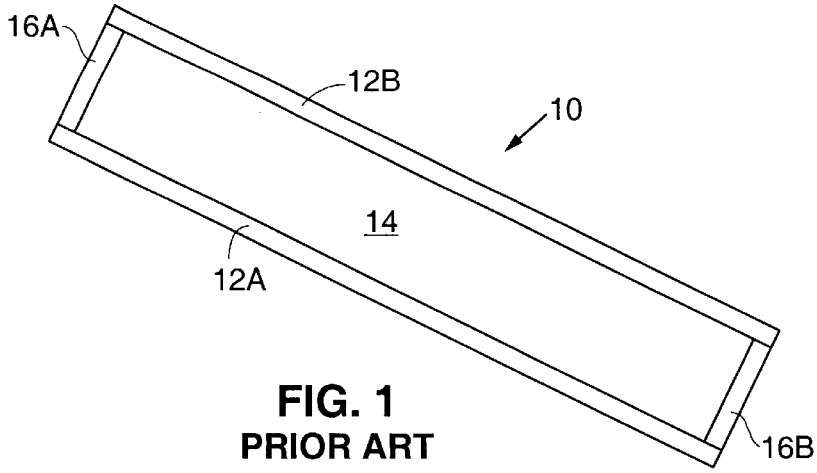
FIG. 1 PRIOR ART
FIG. 1 is a plan view of a conventional binder strip, with the adhesive side showing.

A determination is first made as to whether the operator has inserted a cut edge of the strip into the machine. As previously noted, if the strip is cut to accommodate a non-standard length stack, the operator should insert the uncut edge first so that a gap 16A/16B (FIG. 1) will be positioned properly so as to absorb any excess molten adhesive 14. Each end of the binder strip has a relatively high reflectivity segment having a length LS. Length LS is selected to be longer than any of the relatively high reflectivity segments on the strip so that if the strip is cut at any location, the worst case length of any leading relatively high reflectivity segment will be less than a minimum value Lsmin. Thus, as indicated by element 50, the drive motor is driven one step and a determination is made, as shown by element 52, if point PA is detected by sensor 36A/36B. Sensor 36A/36B senses the transition from a relatively high reflectivity region to a relatively low reflectivity region. Initially, the transition will not be detected so, as indicated by element 52, the sequence will return to element 46 and the motor will be stepped a second time as indicated by element 50, with this loop continuing until point PA is detected. If the location of what appears to be point PA exceeds a predetermined maximum value it is possible that the strip has been encoded only along one edge so that the encoding cannot be detected, as will be explained. In that case, the operator incorrectly inserted the strip in reverse.

As previously noted, some strip types must be inserted in the proper direction to ensure that the portion of the strip intended to be associated with the front cover of the stack 20 will, in fact, be applied to the front cover of the stack. As shown be element 56, the sequence jumps to element 82 of FIG. 4C which indicates that the drive motor is reversed so that the strip will proceed to be ejected. An error message will also be displayed, indicating by way of example, that the strip should be reversed and reinserted. Eventually, the outer sensor 34A/34B (FIG. 5) will indicate that the strip has been ejected so that the sequence can return to the beginning at element 42 of FIG. 4A where the machine waits to sense the reinserted strip.

Assuming that point PA has been detected, a value that corresponds to LS, the distance between the leading edge of the strip 30 and point PA, is stored. Assuming that the location of point PA does not exceed some maximum distance (element 56 of FIG. 4A), a determination is then made as to whether the stored value for LS is less than a stored value minimum valued Lsmin, as indicated by element 58. If the value is less, the relatively high reflectivity region at the end of the strip must be all or part of an intermediate relatively high reflectivity region that was cut by the operator. In that event, the strip was improperly inserted with the cut end first so that the strip needs to be reversed and reinserted. Thus, the sequence will proceed to element 82 of the FIG. 4C flow chart where the strip is ejected and an error message displayed.

Assuming that the strip has been properly inserted, the strip will continue to be driven into the machine so that the next two points, points PB and PC, can be ascertained, as indicated by element 60. Point PB is detected when the strip encoding changes from a relatively low reflectivity region to a relatively high reflectivity region. The distance between points PA and PB represents length LEA (FIG. 3). Point PC is detected when the strip encoding changes from a relatively high reflectivity to a relatively low reflectivity. The distance between points PA and PC represents length L2A. The measured value of L2A should correspond to one cycle L2 of the embedded coding, a value which is fixed for all strip types. If L2A exceeds a maximum value for L2, maximum value Lmax2, points PB and PC were not found. In that event, the strip will be ejected, as indicated by element 62, according to the flow chart of FIG. 4C.

Assuming that the maximum value Lmax2 was not exceeded, a determination is then made as to whether the measured value L2A falls within a predetermined acceptable range for the nominal value for cycle length L2. As indicated by element 64, if L2A falls outside the acceptable range, the values corresponding to points PB and PC are not used to determine the strip type. The sequence then returns to element 60 and an attempt is made to read the next two points (PD and PE) on the strip as the strip is fed into the binding machine.

If the value of L2A is within the acceptable range, the ratio of values LEA to L2A can then be used to determine the strip type. However, in order to further reduce possible errors, a second measurement is taken while the strip continues to be drawn into the binding machine. The sequence will proceed to element 66 of FIG. 4B. As indicated, the location of the next two points on the strip, points PD and PE, is then determined. The distance between points PC and PE corresponds to a second measurement L2B of cycle length L2. If the measured value L2B exceeds the maximum value Lmax2, points PD and PE were not found. In that event, the strip will be ejected according to the flow chart of FIG. 4C, as indicated by element 68. Assuming that L2B has not exceeded the maximum value, a determination is made as to whether the measured value of L2B falls within the acceptable range for the nominal value of cycle length L2, as indicated by element 70. If the value of L2B does not fall within the range, a further measurement is attempted as indicated by element 70 of FIG. 4B and element 60 of FIG. 4A. If the value of L2B is acceptable, the two ratios of L1A/L2A and L1B/L2B are then calculated, as indicated by element 72. Next, the two ratios are compared with one another as indicated by element 74. If the two ratios differ from one another more than a predetermined amount, at least one of the measurements was in error. As indicated by element 74 and 60, a further pair of measurements is made.

Assuming that the ratios agree within the acceptable tolerance, the ratios are used in connection with a look up table stored in the binding machine 18, as indicated by element 76. The look up table produces one of seven selected strip type identifiers based upon an input that corresponds to a measured range of L1/L2 ratios. The comparison indicated by element 74 confirms that the two measurements fall within one of the ranges, so that a selected one of the seven strip type identifiers will be produced from the look up table. The binding machine then displays the strip type and proceeds to automatically adjust the operation of the binding sequence to correspond to the strip type as shown by element 78.

Figure 7:
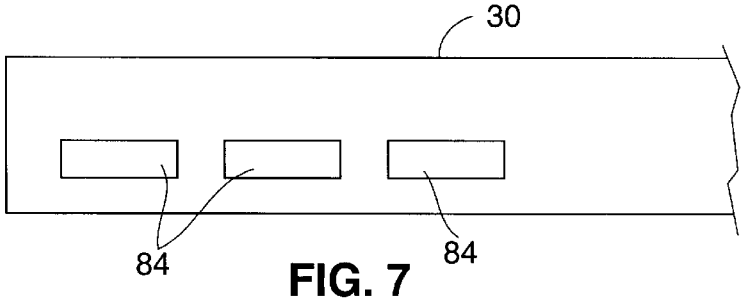
FIG. 7 is an alternative binder strip in accordance with the present invention with the encoded information being disposed only along one side of the strip to permit the feed direction of the strip to be ascertained.

As previously noted, one technique for determining if a binder strip has been correctly inserted into the binding machine is to encode the strip only along one edge of the strip as shown in FIG. 7. The optical sensor 36A/36B (FIG. 5) is offset from the binder strip feed path so that the encoded information 84 on binder strip 30 can be detected only when the strip is fed into the binder machine in one direction. If the strip is fed in the opposite direction, the encoded information cannot be read, the machine ejects the strip and causes an error message to be displayed instructing the operator to reinsert the strip in the proper direction as previously described in connection with element 56 of FIG. 4A and FIG. 4C. As is the case with the encoded pattern of FIG. 7, the encoded pattern is preferably arranged asymmetrically on the adhesive surface with respect to the central longitudinal axis of the strip.

Figure 8:
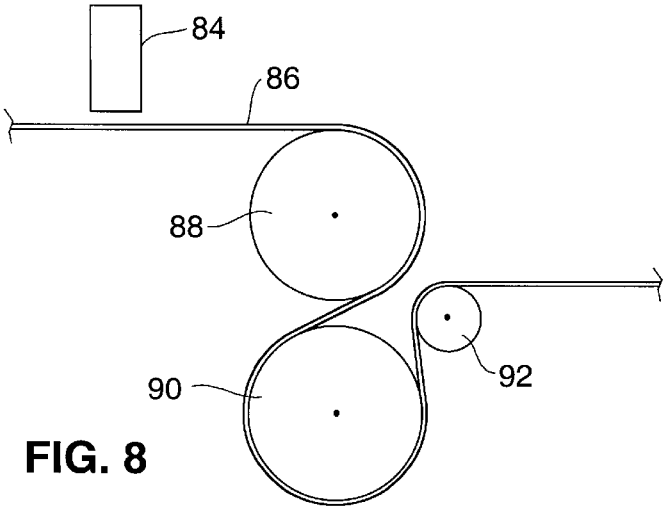
FIG. 8 is a schematic diagram of machinery for the manufacture of encoded binder strips, including a chill roller and an encoding roller.

FIG. 8 shows one exemplary technique for encoding the subject binder strips. The binder strips are typically manufactured in a continuous process. Adhesives strips 12A/12B and 14 (FIG. 1) are deposited on a single web 86 of substrate material by way of adhesive extruder 84 which ejects molten heat activated adhesive stripes as the substrate material passes under the extruder. Typically, the web 86 is sufficiently wide to allow several binder strips to be made in parallel. Extruder 84 deposits adhesive stripes for six or more binder strips so that multiple binder strips are formed at the same time. The extruders for the central adhesive band 14 are periodically turned off and on so that the gaps 16A and 16B are formed at what will be the ends of the strip.

Figure 9:
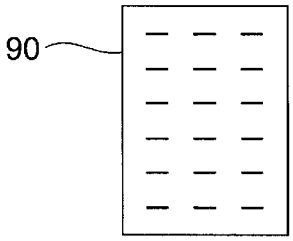
FIG. 9 is a side view showing an outer surface of the encoding roller of FIG. 8.

After the heated adhesive is deposited on the substrate 86, the substrate is passes over a chill roller 88 that cools the adhesive sufficiently so as to prevent the adhesive from flowing off of the substrate. The substrate web 86 and adhesive are passed over an encoding roller 90 having a patterned outer surface (FIG. 9) that corresponds to the encoded information to be imbedded onto the strips. The pattern is formed on the outer roller surface by etching or other suitable means so as to produce a roughened surface in preselected regions. When the adhesive is passed over the outer surface of roller 90, a textured surface is selectively formed on the surface of the adhesive since the adhesive is still soft at this point. The textured surface has a reflectivity that is low relative to the reflectivity of the non-textured surface. Idler roller 92 maintains tension on the substrate to assist in the formation of the textured surfaces. The substrate 86 is then passed through a cutter (not shown) that operates to cut the substrate into individual binder strips.

Thus, a novel encoded binder strip and related method have been disclosed. Although one embodiment has been described in some detail, it is to be understood that certain changes can be made by those skilled in the art without departing from the spirit and scope of the invention as defined by the appended claims. By way of example, other coding schemes than disclosed herein could be readily adapted which can be used to distinguish binder strip types and binder strip feed directions. Further, other techniques can be employed for altering the reflectivity of the adhesive other than the use of a textured wheel. An advantage of the use of a roughened wheel surface is that very little modification of the binder strip manufacturing process is required so that the encoding process adds essentially nothing to the cost of manufacturing the strip. Typically, encoding roller 90 does not even need to be added to the manufacturing equipment since the roller is usually present, functioning as a chill roller.

What is claimed is:

1. An encoded binder strip for binding a stack of sheets along a length of the stack of sheets, said binder strip comprising:

an elongated substrate having a length that corresponds to the length of the stack of sheets and with the substrate defining a major axis along the substrate length; and an adhesive matrix formed on a surface of the substrate, with the binder strip having a predetermined encoded pattern comprising relatively high reflectivity regions and relatively low reflectivity regions when the binder strip is viewed from an adhesive side of the binder strip, with the encoded pattern being disposed so as to be sequentially readable by a binding machine sensor as the sensor scans the encoded pattern above the adhesive matrix and along a path parallel to the major axis.

2. The encoded binder strip of claim 1 wherein the adhesive matrix includes a heat-activated adhesive.

3. The encoded binder strip of claim 1 wherein the relatively low reflectivity region includes a textured pattern formed on an outer surface of the adhesive matrix.

4. The encoded binder strip of claim 1 wherein the encoded pattern is formed asymmetrically with respect to a central longitudinal axis of the elongated substrate.

5. The encoded binder strip of claim 1 wherein the encoded pattern is repeated at least once along a length of the binder strip.

6. The encoded binder strip of claim 1 wherein the pattern controls operation of a binding machine into which the binder strip is loaded.

7. The binder strip of claim 1 wherein the encoded pattern controls operation of a binding machine in which the binder strip is loaded and wherein the encoded pattern identifies the binder strip as one of at least two different binder strip types, with the encoded pattern corresponding to a first one the binder strip types causing binding machine operation which differs from binding machine operation caused by the encoded pattern corresponding to a second one of the binder strip types.

8. An encoded binder strip for binding a stack of sheets along a length of the stack of sheets, said binder strip comprising:

an elongated substrate defining a major axis along a length of the substrate;

a matrix of heat activated adhesive disposed on a surface of the substrate, with the matrix having a predetermined encoded pattern disposed on a surface of the matrix, with the predetermined coded pattern comprising relatively high reflectivity regions and relatively low reflectivity regions, with the relatively low reflectivity regions being formed by a textured surface on the adhesive matrix and with the predetermined coded pattern being repeated at least once a distance along the substrate equal to the length of the stack of sheets.

9. The encoded binder strip of claim 8 wherein the pattern controls operation of a binding machine into which the binder strip is loaded.

10. The binder strip of claim 8 wherein encoded pattern is sequentially readable by a binding machine sensor as the sensor scans the encoded pattern along a path parallel to the major axis.

11. The binder strip of claim 8 wherein the encoded pattern controls operation of a binding machine in which the binder strip is loaded and wherein the encoded pattern identifies the binder strip as one of at least two different binder strip types, with the encoded pattern corresponding to a first one the binder strip types causing binding machine operation which differs from binding machine operation caused by the encoded pattern corresponding to a second one of the binder strip types.

12. A binder strip for binding a stack of sheets along a length of the stack of sheets and having encoded information for controlling operation of a binding machine, said binder strip including:

an elongated substrate having a length that generally corresponds to the length of the stack of sheets and with the substrate defining a major axis along the substrate length and;

a matrix of heat activated adhesive disposed on a surface of the substrate, with the matrix having a predetermined encoded pattern disposed on a surface of the matrix which controls operation of a binding machine into which the binder strip is loaded, with the pattern comprising relatively high reflectivity regions and relatively low reflectivity regions, with the relatively low reflectivity regions being formed by a textured surface on the adhesive matrix.

13. The binder strip of claims 12 wherein the encoded pattern is sequentially readable by a sensor of the binding machine as the sensor scans the encoded pattern along a path parallel to the major axis.

14. The binder strip of claim 12 wherein the encoded pattern controls operation of a binding machine in which the binder strip is loaded and wherein the encoded pattern identifies the binder strip as one of at least two different binder strip types, with the encoded pattern corresponding to a first one the binder strip types causing binding machine operation which differs from binding machine operation caused by the encoded pattern corresponding to a second one of the binder strip types.

15. An encoded binder strip for binding a stack of sheets along a length of the stack of sheets, said binder strip comprising:

an elongated substrate having a length that generally corresponds to the length of the stack of sheets and with the substrate defining a major axis along the substrate length;

a heat-activated adhesive matrix formed on a first surface of the substrate; and an encoded pattern readable by a binding machine which identifies the binder strip as one type of a multiplicity of different binder strip types, with the encoded pattern functioning to control operation of the binding machine, with the encoded pattern being sequentially readable by a sensor of the binding machine as the sensor scans the encoded pattern along a path parallel to the major axis.

16. The encoded binder strip of claim 15 where the multiplicity of different binder strip types is at least five types.

17. The encoded binder strip of claim 15 wherein the encoded pattern is not observable once the binder strip has been used to bind a stack of sheets.

18. The binder strip of claim 15 wherein the multiplicity of different binder strip types includes first and second binder strip types, with the respective encoded patterns corresponding to the respective first and second binder strip types controlling operation of the binding machine in a differing manner.

19. The encoded binder strip of claim 16 wherein the encoded pattern is formed in the heat-activated adhesive matrix.

20. The encoded binder strip of claim 19 where the encoded pattern comprises relatively high reflectivity regions and relatively low reflectivity regions in the heat-activated matrix.

21. The binder strip of claim 18 wherein the encoded pattern is repeated at least once along the major axis.

22. An encoded binder strip for binding a stack of sheets along a length of the stack of sheets, said binder strip comprising:

an elongated substrate having a length that generally corresponds to the length of the stack of sheets and with the substrate defining a major axis along the substrate length;

a heat-activated adhesive matrix formed on a first surface of the substrate; and an optically encoded pattern readable by a binding machine and formed in the heat-activated adhesive matrix, with the pattern functioning to control operation of the binding machine.

23. The encoded binder strip of claim 22 wherein the encoded pattern functions to identify the binder strip as one type of a multiplicity of binder strip types.

24. The binder strip of claim 22 wherein the encoded pattern is sequentially readable by a sensor of the binding machine as the sensor scans the encoded pattern along a path parallel to the major axis.

25. The binder strip of claim 22 wherein the encoded pattern identifies the binder strip as one of at least two different binder strip types, with the encoded pattern corresponding to a first one the binder strip types causing binding machine operation which differs from binding machine operation caused by the encoded pattern corresponding to a second one of the binder strip types.

26. The binder strip of claim 24 wherein the encoded pattern is repeated at least once along the major axis.

27. An encoded binder strip to be used for binding a stack of sheets using a binding machine along a length of the stack of sheets, said binder strip comprising:

an elongated substrate having a length that generally corresponds to the length of the stack of sheets prior to binding;

an adhesive matrix on a first surface of the substrate which functions to bind the stack of sheets to the substrate; and an optically encoded pattern which functions to control operation of the binding machine, with the encoded pattern being disposed on the binder strip such that the pattern is not observable once the binder strip has been used for binding the stack of sheets and wherein the encoded pattern functions to identify the binder strip as one type of a multiplicity of binder strip types.

28. The encoded binder strip of claim 27 wherein encoded pattern comprises relatively high and relatively low reflectivity regions on the adhesive matrix.

29. An encoded binder strip to be used for binding a stack of sheets using a binding machine along a length of the stack of sheets, said binder strip comprising:

an elongated substrate having a length that generally corresponds to the length of the stack of sheets prior to binding;

an adhesive matrix on a first surface of the substrate which functions to bind the stack of sheets to the substrate; and an optically encoded pattern which functions to control operation of the binding machine, with the encoded pattern being disposed on the binder strip such that the pattern is not observable once the binder strip has been used for binding the stack of sheets and wherein the encoded pattern is sequentially readable by a sensor of the binding machine as the sensor scans the encoded pattern along a path parallel to a major axis of the substrate.

30. The binder strip of claim 29 wherein the encoded pattern is repeated at least once along the major axis.

31. An encoded binder strip to be used for binding a stack of sheets using a binding machine along a length of the stack of sheets, said binder strip comprising:

an elongated substrate having a length that generally corresponds to the length of the stack of sheets prior to binding;

an adhesive matrix on a first surface of the substrate which functions to bind the stack of sheets to the substrate; and an optically encoded pattern which functions to control operation of the binding machine with the encoded pattern being disposed on the binder strip such that the pattern is not observable once the binder strip has been used for binding the stack of sheets and wherein the encoded pattern identifies the binder strip as one of at least two different binder strip types, with the encoded pattern corresponding to a first one the binder strip types causing binding machine operation which differs from binding machine operation caused by the encoded pattern corresponding to a second one of the binder strip types.

32. An encoded binder strip for binding a stack of sheets along a length of the stack of sheets, said binder strip comprising:

a substrate;

an adhesive matrix formed on a surface of the substrate, with the binder strip having a predetermined encoded pattern comprising relatively high reflectivity regions and relatively low reflectivity regions when the pattern is viewed from an adhesive side of the binder strip, with the pattern being disposed along an axis of the substrate so as to be sequentially readable by a binding machine sensor as the sensor scans the encoded pattern along the axis and with the encoded pattern being repeated at least once along the axis.

33. The binder strip of claim 32 wherein the encoded pattern identifies the binder strip as one of at least two different binder strip types, with the encoded pattern corresponding to a first one the binder strip types causing binding machine operation which differs from binding machine operation caused by the encoded pattern corresponding to a second one of the binder strip types.

* * * * *

UNITED STATES PATENT AND TRADEMARK OFFICE

CERTIFICATE OF CORRECTION

PATENT NO. : 6,599,074 B2
DATED : July 29, 2003
INVENTOR(S) : Kevin P. Parker

It is certified that error appears in the above-identified patent and that said Letters Patent is hereby corrected as shown below:

Column 8,
Lines 3 and 35, between “one” and “the” insert -- of --.

Column 9,
Line 62, between “one” and “the” insert -- of --.

Column 10,
Line 50, between “machine” and “with” insert -- , --.

Signed and Sealed this

Twenty-first Day of October, 2003

JAMES E. ROGAN
*Director of the United States Patent and Trademark Office*